United States Patent [19]

Hamada

[11] 4,051,548

[45] Sept. 27, 1977

[54] ELECTRIC LOCKING DEVICE

[75] Inventor: Morio Hamada, Hino, Japan

[73] Assignee: Tokao Murata, Tokyo, Japan

[21] Appl. No.: 639,174

[22] Filed: Dec. 9, 1975

[30] Foreign Application Priority Data

Aug. 14, 1975 Japan ..... 50-98042
Aug. 14, 1975 Japan ..... 50-98043

[51] Int. Cl.[2] ..... H01H 47/00

[52] U.S. Cl. ..... 361/171; 70/278; 70/280

[58] Field of Search ..... 70/278, 279, 280; 317/134; 361/171

[56] References Cited

U.S. PATENT DOCUMENTS

| | | | |
|---|---|---|---|
| 1,283,845 | 11/1918 | Marchant | 70/278 |
| 2,436,809 | 3/1948 | Joel | 317/134 X |
| 3,266,278 | 8/1966 | Ennitt | 70/280 X |
| 3,513,357 | 5/1970 | Dittmore | 70/278 X |
| 3,562,596 | 2/1971 | Scheuer | 317/134 |
| 3,854,310 | 12/1974 | Paull et al. | 70/279 X |
| 3,893,723 | 7/1975 | Boule | 70/279 X |
| 3,933,382 | 1/1976 | Counts et al. | 70/280 X |

*Primary Examiner*—Roy D. Frazier
*Assistant Examiner*—Rodney H. Bonck

[57] ABSTRACT

An electric locking device comprising a plurality of manipulative control switches, a presetting mechanism having a plurality of variable connecting mechanisms capable of selectively varying and presetting connected states with respect to the manipulative control switches, a relay circuit including a plurality of relays respectively connected to the variable connecting mechanisms and being successively supplied with electric power when the manipulative control switches to which the variable connecting mechanisms are selectively connected are closed in a specific sequence, the relays being so connected that, as a result of energization of one relay, a relay switch of that one relay closes, whereby the succeeding relay in the specific sequence assumes an energizable state, and, at the same time, the relay switch assumes a lock-up state, and a circuit operated by the energization of the final relay in the specific sequence of the relay of the relay circuit to cause a locking mechanism to perform an unlocking operation.

1 Claim, 9 Drawing Figures

10
11
12
13
14
15
16
17
18
19
K1
K2
K3
K4
K5
K6
K7
K8
K9
K0
A
B

ELECTRIC LOCKING DEVICE

BACKGROUND OF THE INVENTION

The present invention relates generally to electric locking devices and more particularly to an electric locking device provided with unlocking means which can be electrically unlocked only when manipulative control is carried out to read out preset numerals in a specific sequence.

Among the locking devices known heretofore, there have been locking devices which are mechanically unlocked with a key or a manually operated dial. For a key type locking device, the user must take the trouble of always carrying the key whenever he may wish to unlock the device, and, if he should fail to carry the key because of some reason such as loss or misplacing of the key, he would be unable to unlock the device. Another problem accompanying this key type locking device is that there is the possibility of the device being picked in a simple manner with a tool such as a piece of piano wire by a thief. A problem accompanying the dial type locking device is that there is the possibility of this device being unlocked in a simple manner by a skilled thief using a device such as a stethoscope to hear the operational sounds of the device mechanism.

Accordingly, with the aim of overcoming the above mentioned shortcomings of the known mechanical locking devices, various electric type and electronic type locks have heretofore been proposed.

Among the known electric locking devices, there has been one wherein electrical relays operate to accomplish unlocking operation only when, of $n$ push buttons, for example, $k$ push buttons are successively depressed in a predetermined pushing sequence. However, since the pushing sequence cannot be varied, the user must be careful, when unlocking the device, to prevent the pushing sequence being observed and memorized by another party.

Among the known electronic locking devices, there has been one wherein the sequence for pushing push buttons can be set and varied at will. However, since components such as integrated circuits are used in this type of locking device, malfunctioning or erroneous operation due to causes such as noise and voltage fluctuations readily occurs. Moreover, these devices are expensive.

SUMMARY OF THE INVENTION

Accordingly, it is a general object of the present invention to provide a novel and useful electric locking device in which the above described difficulties have been overcome.

Another and more specific object of the invention is to provide an electric locking device which has unlocking means which is electrically unlocked only when manipulative control is carried out to read out preset numerals in a specific sequence, and in which the set numerals and the sequence can be changed and reset at will.

Still another object of the invention is to provide an electric locking device so adapted that when an error occurs in the numerals and their sequence in their reading out by manipulative control, all circuits in the device return to their states prior to the manipulative control. By this provision, an extremely long time would be required for unlocking by manipulating in a trial-and-error manner, whereby unlocking would be practically impossible.

Further objects and features of the invention will be apparent from the following detailed description with respect to preferred embodiments of the invention when read in conjunction with the accompanying drawings.

DETAILED DESCRIPTION

Figures 1A, 1B, 1C:
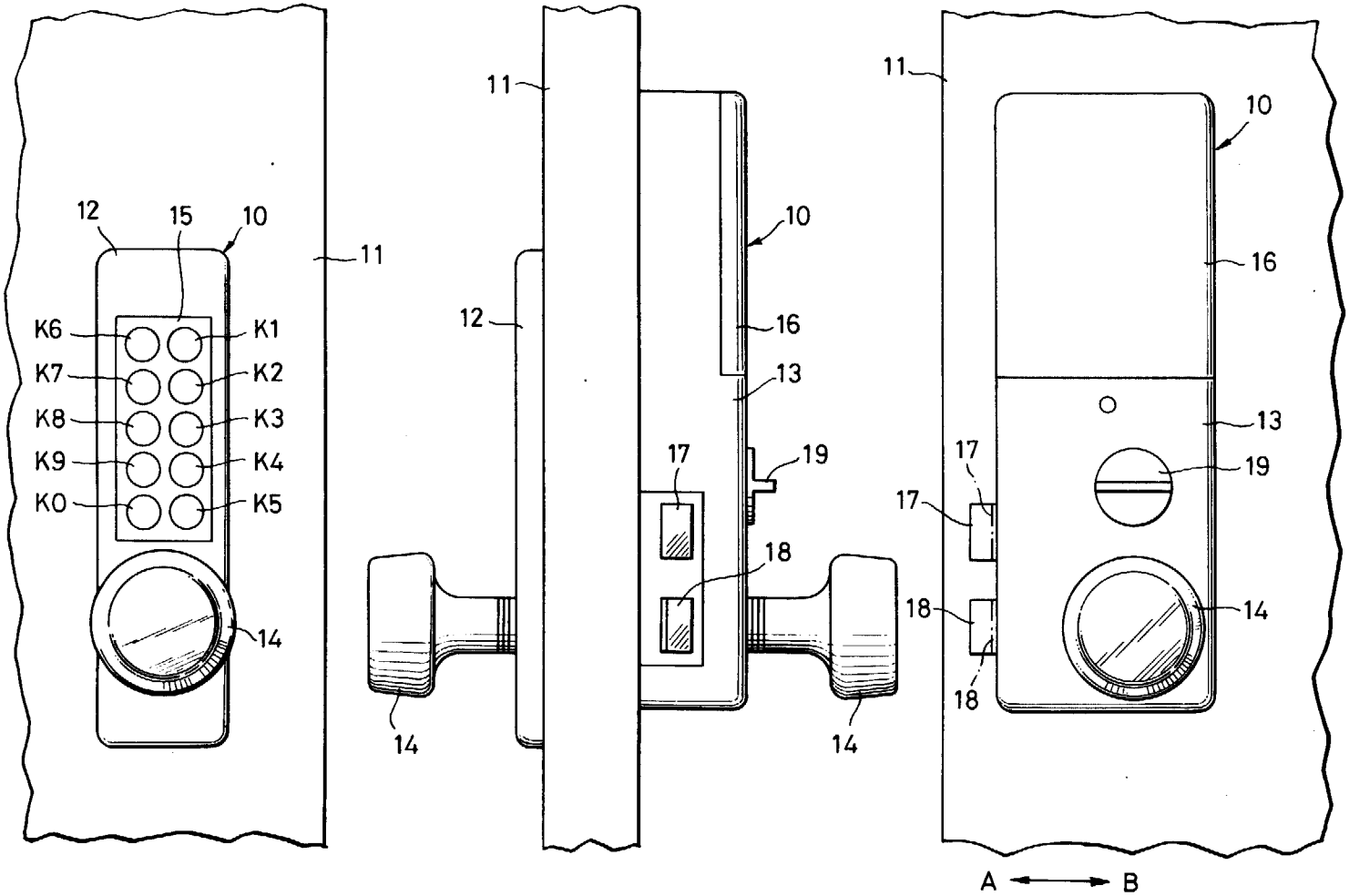
FIGS. 1A, 1B, and 1C are respectively a front elevation, a side elevation, and a rear elevation showing one example of an electric locking device according to the present invention in a state wherein it is installed in a door.

Referring first to FIGS. 1A, 1B, and 1C, an electric locking device 10 according to the invention, which is installed in a specific part of a door 11, has as its principal exterior parts, a manipulatable control box 12 projecting slightly outward from the front face of the door 11, a circuit box 13 disposed on the rear face of the door 11, and manually operable door knobs 14 respectively projecting outwardly in opposite directions from the front and rear faces of the control box 12 and the circuit box 13.

The control box 12 at its upper part has a pushbutton panel 15 on which are arranged a right-hand vertical column of push buttons K1 through K5 and a left-hand vertical column of push buttons K6 through K0 as viewed in front elevation in FIG. 1A. The arrangement of the push buttons need not be limited to that shown in FIG. 1A. These push buttons K1 through K0 are so adapted that more than one button cannot be mechanically depressed at the same time. The reason for this is that, when all of these push buttons are pushed at one time, internal relay circuits as described hereinafter operate, and there is the possibility of the electric lock 10 assuming an unlocked state.

The circuit box 13 accommodates therewithin relay circuits described hereinafter and operated by appropriate depressing of the push buttons K1 through K0. The circuit box 13 is provided at its upper part with a cover 16, which can be opened for purposes such as changing the circuit connections of the relay circuits and checking the circuits. In order to prevent tampering by unauthorized persons, this cover 16 is so adapted that it cannot be opened unless a special tool is used.

A horizontal lock bolt 17 is provided in the circuit box 13 and is adapted to project outward at its outer working end to accomplish locking, being driven in horizontal sliding movement in the arrow directions A and B as shown in FIG. 1C through a specific distance by a motor rotating in forward and reverse directions in accordance with signals from the above mentioned relay circuits. When this lock bolt 17 is in its position indicated by full line in FIG. 1C with the door 11 in closed position relative to its doorway frame (not shown), the lock bolt 17 is fitted in and engaged with a mating hole in a stationary lock strike fixed to the jamb member of the doorway frame, thereby locking the door 11. When the lock bolt 17 is in its retracted position indicated by single-dot chain line, it is disengaged from the stationary door strike, and the door 11 is unlocked.

As described more fully hereinafter, by successively depressing a specific number of push buttons of the above mentioned 10 push buttons K1 through K0 according to a depressing sequence determined by the circuit connections of the above mentioned relay circuits, the lock bult 17 can be actuated through the relay circuits and the above mentioned motor in retracting movement thereby to plate the electric lock 10 in unlocking state.

Furthermore, when the electric lock 10 is in its unlocking state, the door 11 can be opened by turning the manually operable door knob 14 either from the outer (front) side or the inner (rear) side to cause a latch bolt 18 to slidingly retract in the arrow direction B in FIG. 1C to the state indicated by the single-dot chain line. In addition, a manual operation knob 19 is provided on the rear face of the circuit box 13 at a position slightly above the door knob 14. By turning this knob 19 from the inner side of the door, the lock bolt 17 can be moved in the arrow direction A or B to lock or unlock the door 11 irrespective of whether or not the power supply for the electrical system of the lock is turned on and irrespective of the state of the above mentioned circuits.

Figure 2:
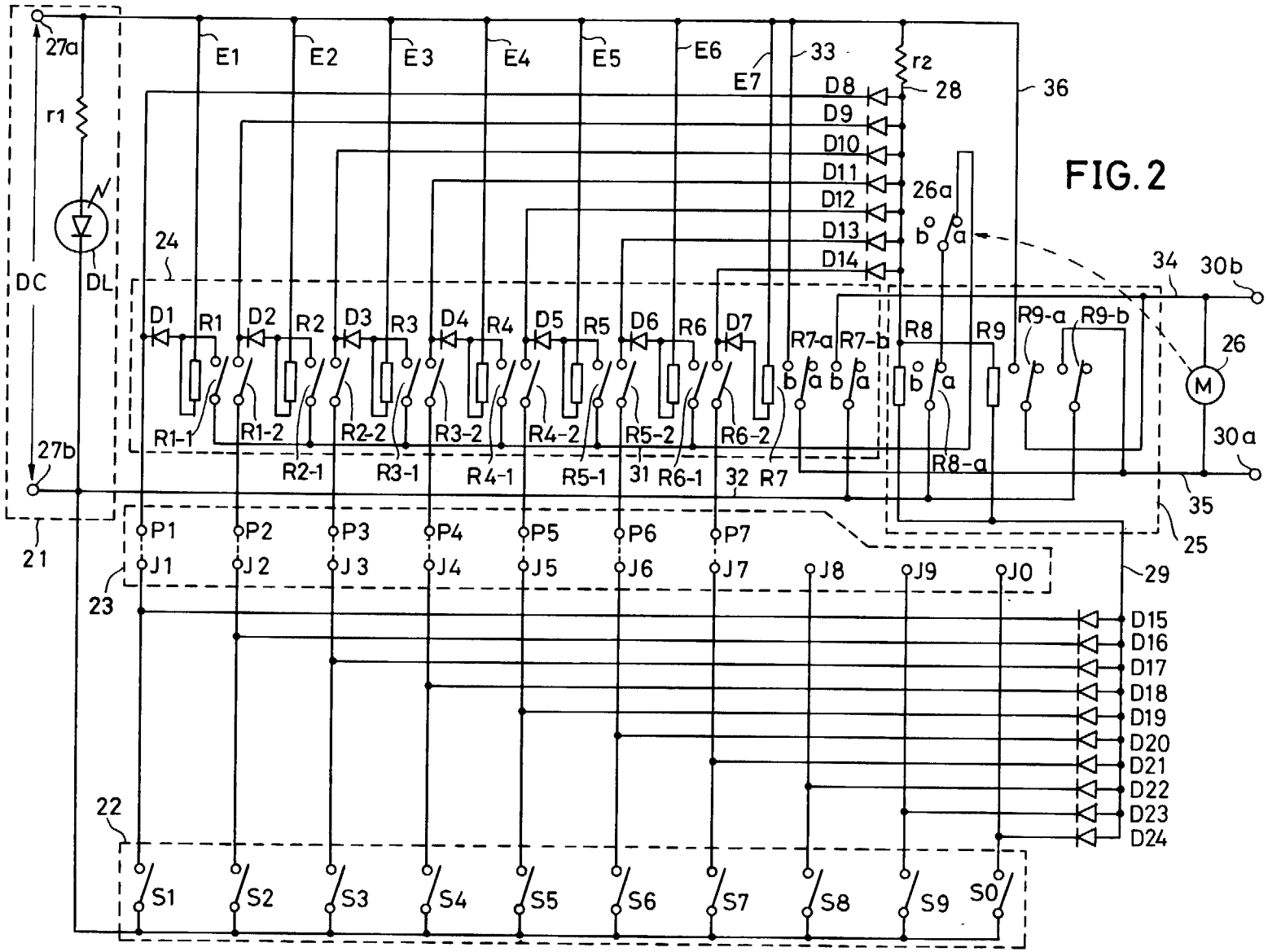
FIGS. 2 through 6 are circuit diagrams respectively showing first through fifth embodiments of electrical circuits of the electric locking device of the invention.

In a first embodiment of the invention as illustrated in FIG. 2, the relay circuit shown therein comprises, generally, a power-supply block 21, a switch block 22, a variable setting block 23, a relay block 24 for unlocking, a relay block 25 for circuit resetting and locking, and a motor 26.

The power supply of the power-supply block 21 is a direct-current power source of a voltage of the order of 6 to 12V and has a ⊕ side terminal *27a* and a ⊖ side terminal *27b*. This direct-current power supply is ordinarily obtained by passing power from a commercial power supply through a transformer and then rectifying the same, but when there is a power failure, the power supply is automatically changed over to a battery. A light-emitting diode DL is connected between the power supply terminals *27a* and *27b*. The ON/OFF state of the power supply can be readily verified by means of this light-emitting diode DL.

The switch block 22 comprises ten normally-open switches S1 through S0 connected in series and respectively closed by the depressing of the above mentioned ten push buttons K1 through K0. The variable setting block 23 is of a type wherein variable type connectors are used and comprises ten jacks J1 through J10 connected respectively to the above mentioned ten switches S1 through S0 and seven plugs P1 through P7 which are respectively connectable with these jacks in a manner such that their connected combinations are variable.

For the sake of convenience in the description of the instant embodiment set forth hereinunder, the description relates to the state wherein the plugs P1 through P7 have been connected respectively to the jacks J1 through J7, thereby establishing a specific circuit connection. The unlocking relay block 24 comprises seven relays for unlocking R1 through R7 respectively corresponding at their terminals on one side to the seven plugs P1 through P7 and respectively connected at their other terminals to the ⊕ side terminal *27a*. The relays R1 through R6 respectively have pairs of normally open contact points R1-1 and R1-2, R2-1 and R2-2, . . . R6-1 and R6-2, while the relay R7 has a pair of changeover contact points R7-*a* and R7-*b*. For these relays R1 through R7, ultraminiaturized and long-life relays such as microreed-relays are preferably used.

The relay block 25 for circuit resetting and locking comprises a circuit resetting relay R8 and a locking relay R9 connected in parallel. The terminals of these relays R8 and R9 on one side thereof are respectively connected through a line 28 to the aforementioned ⊕ side terminals *27a*, while the terminals on the other side of these relays R8 and R9 are respectively connected through a line 29 to be branched and by way of diodes D15 through D24 to the above mentioned switches S1 through S0. The relay R8 ha a changeover switch contact R8-*a*, and the relay R9 has a pair of changeover switch contacts R9-*a* and R9-*b*.

The movable contact *26a* of a microswitch is mechanically intercoupled with the rotation of the motor 26. Diodes D1 through D14 and the above mentioned diodes D15 through D24 are provided for prevention of reverse flow. Resistors r1 and *r2* are connected between the above mentioned ⊕ side terminal *27a* and the diode DL and the commonly connected side of the diodes D8 through D14, respectively. Emergency power supply terminals *30a* and *30b* are connected to the motor 26 and relays as shown.

The manipulative unlocking operation through the above described relay circuit is as follows.

First, the push button K1 is depressed to close the switch S1. Thereupon a first excitation circuit comprising a line E1, the relay R1, the diode D1, the plug P1, the jack J1, and the switch S1 is closed, and the relay R1 is energized. Consequently, the normally open contacts R1-1 and R1-2 close, whereby a first self-holding circuit formed through the line E1, the relay R1, the contact R1-1, a line 31, the contacts *26a* and R8-*a*, and a line 32 is closed, and the relay R1 is self held. Therefore, even when the push button K1 is released to open the switch S1, the contacts R1-1 and R1-2 are held in their closed state.

When the above mentioned switch S1 is closed, a circuit for releasing the self-holding formed through the line 28, the relay R8, the line 29, the diode D15, and the switch S1 is also closed at the same time, whereby the relay R8 should be energized. However, the current is short circuited by a first short-circuiting circuit formed through the line 28, the diode D8, the plug P1, the jack J1, and the switch S1. For this reason, the relay R8 is not energized in actuality, and the contact R8-a remains closed. Therefore, the above mentioned first self-holding circuit remains closed. This result is the same also in the cases wherein the succeeding switches S2 through S7 are closed.

Next, the push button K2 is depressed in accordance with the preset sequence to close the switch S2. Since, at this time, the contact R1-2 is closed as mentioned above, a second excitation circuit formed through the line E2, the relay R2, the diode D2, the plug P2, the jack J2, and the switch S2 is closed, and the relay R2 is energized. Consequently, the contacts R2-1 and R2-2 corresponding to the relay R2 are closed, and, similarly as in the preceding case, a second self-holding circuit formed through contacts R2-1, *26a*, and R8-*a* is closed, whereby the relay R2 is self held.

When, in a similar manner, the push buttons K3 through K6 are successively depressed in accordance with the preset sequence thereby to close successively the switches S3 through S6, the relays R3 through R6 successively become energized, and their contacts R3-1 and R3-2 through R6-1 and R6-2 are successively closed.

Finally, the push button K7 is pushed to close the switch S7, whereupon a seventh excitation circuit formed through the relay R7, the contact R6-2, and the switch S7 is closed. Consequently, the relay R7 is energized, and the changeover contacts R7-*a* and R7-*b* are respectively switched from their contacts *a* to their contact points *b*. This relay R7 is not self held.

When the contacts R7-*a* and R7-*b* are thus switched to their contact points *b*, a circuit for unlocking formed through a line 33, the contact R7*a*, a line 35, the motor 26, a line 34, the contact R7-*b*, and the line 32 is closed, whereby the motor 26 rotates in the forward direction (i.e., unlocking direction). As a result of the rotation of the motor 26, the lock bolt 17 slides in the arrow direction B indicated in FIG. 1C thereby to place the electric lock 10 in its unlocked state. At this time, the microswitch contact 26*a* is actuated interrelatedly with the rotation of the motor 26 to switch over to the contact point *b*. As a consequence, a relay self-holding circuit formed through the line 31, the contacts 26*a* and R8-*a*, and the line 32 is opened, and the above mentioned relays R1 through R6 are released from their self held state and assume an unenergized state.

When the push button K7 is released simultaneously with the above mentioned unlocking, the switch S7 is opened, and the relay R7 is also deenergized. For this reason, the contacts R7-*a* and R7-*b* are also changed over to their contacts *a* and are opened. Consequently, the above mentioned circuit for unlocking is opened, whereby the motor 26 stops.

In this manner, by successively depressing the push buttons K1 through K7 in a specific preset sequence, the electric lock 10 is placed in its unlocked state.

Next, the locking control operation by means of the relay circuit will be described. First, any one push button of the push buttons K2 through K0, other then the push button K1, for example, the push button K3, is depressed to close the switch S3. An excitation circuit for locking formed through the line 28, the relays R8 and R9, the line 29, the diode D17, and the switch S3 is thereupon closed, and the relays R8 and R9 are energized. As a consequence, the changeover contact R8-*a* is changed over and opened, and, furthermore, the changeover contacts R9-*a* and R9-*b* are changed over and closed. A circuit for locking formed through a line 36, the contact R9-*a*, the line 34, the motor 26, the line 35, the contact R9-*b*, and the line 32 is thereupon closed. Consequently, the motor 26 rotates in the reverse direction (i.e., locking direction). As a result, the lock bolt 17 slides in the arrow direction A in FIG. 1C, thereby placing the electric lock 10 in its locked state.

At this time, the microswitch contact 26*a*, which was opened at the time of the above described unlocking, is also closed. Then, when the push button K3 is released, the switch S3 is opened, and the relays R8 and R9 are deenergized. As a consequence, the contacts R8-*a*, R9-*a*, and R9-*b* are opened. Therefore, the motor 26 stops. When the push button K1 is depressed, the above mentioned first short-circuiting circuit operates, whereby the relay R9 does not operate, and locking cannot be accomplished.

In this manner, by depressing any one of the push buttons K2 through K0, excluding the push button K1, the electric lock 10 can be placed in its locked state.

Even if a button is additionally depressed after the above described unlocking or locking operation thereby to cause the motor 26 to rotate, no harm whatsoever results since a specially provided operational mechanism undergoes a slipping action.

Next, the circuit returning or resetting operation at the time when, in the above described relay circuit, the push buttons are depressed in an erroneous sequence will now be described. It will be assumed that, after the push buttons K1 and K2 have been depressed, the push button K3 should be pushed, but the push button K4, for example, has been pushed by mistake. Then, since the push button K3 has not been depressed, the relay R3 is not in its energized state, and the contacts R3-1 and R3-2 also remain in their opened state. For this reason, when the push button K4 is depressed to close the switch S4, a fourth excitation circuit formed through a line E4, the relay R4, the diode D4, the contact R3-2, the plug P4, the jack J4, and the switch S4 and a fourth short-circuiting circuit formed through the line 28, the diode 11, the contact R3-2, the plug P4, the jack J4, and the switch S4 remain opened, and only a resetting circuit formed through the line 28, the relays R8 and R9, the line 29, the diode D18, and the switch S4 is closed. Consequently, the relays R8 and R9 are energized, and the contact R8-*a* opens, while the contacts R9-*a* and R9-*b* close. When the contacts R8-*a* thus opens, the lock-up circuits of the relays R1 and R2 are released, and all circuits return to their original states.

However, if a push button which has been once depressed to cause a specific self-holding circuit to be formed is again depressed, the above mentioned self-held state is not terminated, and the circuit return is not carried out.

In the above described erroneous operation of the push buttons, the contacts R9-*a* and R9-*b* close to close the locking circuit, whereby the motor 26 further rotates in the locking direction. However, since a special operational mechanism undergoes slipping, no harmful effect occurs.

Thus, when an error is made in the button depressing sequence or an unrelated push button is pushed at an intermediate point, and the push buttons are not successively depressed in the prescribed order, the circuits return to their original states. Then, in order to unlock the lock, it becomes necessary to state from the beginning to push the buttons in the correct order. Therefore, in the case where a person who does not know the preset sequence for unlocking depresses the push buttons at random in a wilful attempt to unlock the lock, a long time is required for accidental unlocking. In the case of the instant embodiment, as described hereinafter, the possibility of unlocking by accidental chance is even less owing principally to the extremely large number of combinations of the push button depressing sequence.

An important feature of this invention is that, by applying a specific voltage with an emergency power supply from a position such as a supervision station, for example, across the power supply terminals 30*a* and 30*b* for emergencies, the unlocking or locking of the locking device can be remotely controlled. For this reason, by collectively connecting emergency lines from each entrance door in establishments such as collective houses, motels, and hotels, the system can function as a master key for emergencies and abnormal circumstances. Furthermore, in the case of an ordinary residence, the above mentioned power supply for emergencies can be placed in a sealed container and stored outdoors in a wall or in the ground at a place relatively near the door 11 to be used in an emergency.

Figure 3:
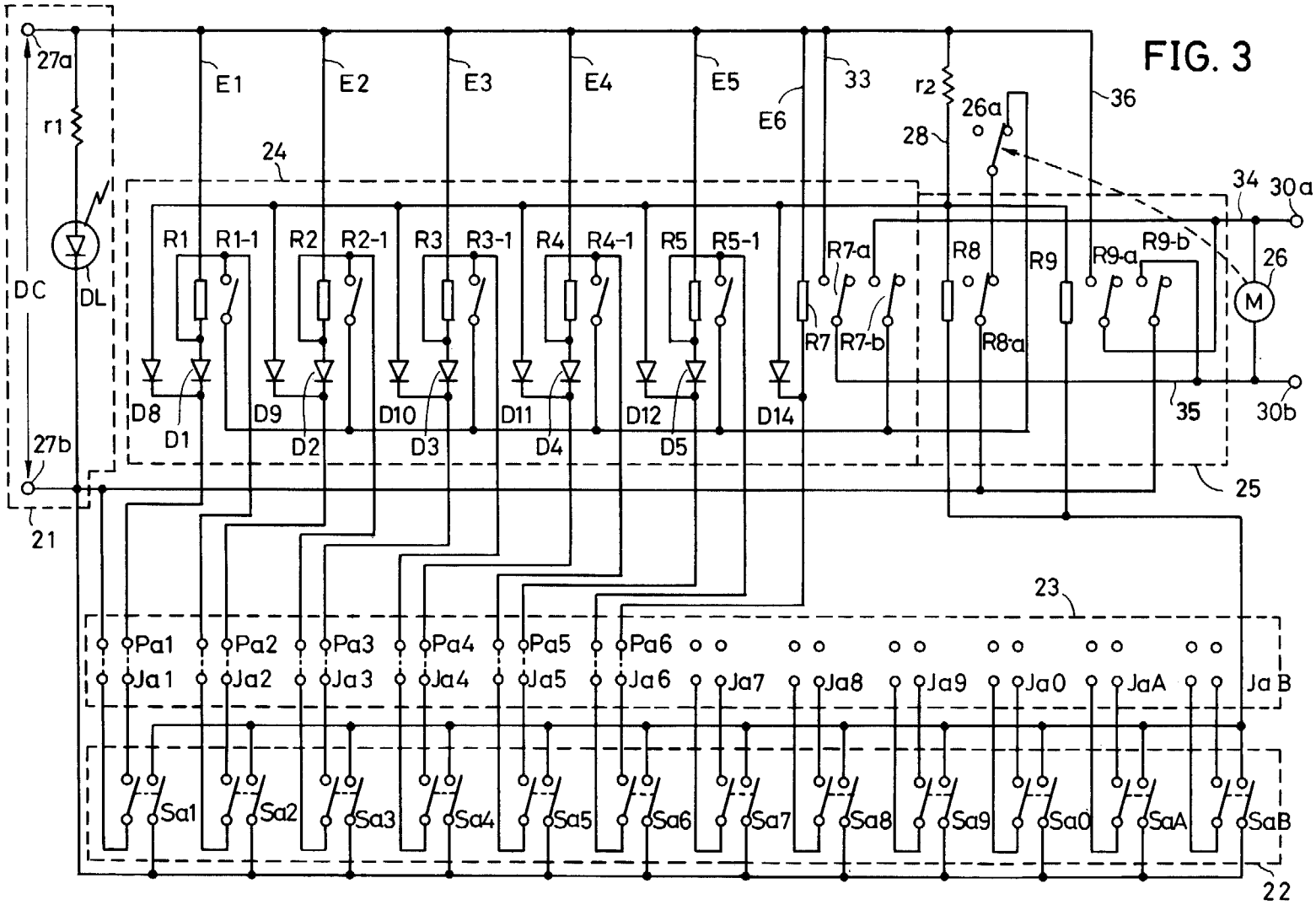

A second embodiment a relay circuit according to the invention is illustrated in FIG. 3. In FIG. 3, parts which are the same as corresponding parts in FIG. 2 are designated by like reference numerals and characters. Such parts will not be described in detail again. This relay circuit shown in FIG. 3 is adapted for unlocking of the locking device by depressing six of twelve push buttons successively in accordance with a preset depressing sequence.

Relays R1 through R5 for unlocking respectively have single normally open contacts. For six plugs *Pa1* through *Pa6* for changing circuit connections, twelve jacks *Ja1* through *Jab*, and twelve switches *Sa1* through *SaB*, respectively, of two-circuit types.

For the sake of convenience in description of the instant embodiment, it will be assumed that the plugs *Pa1* through *Pa6* are connected respectively to the jacks *Ja1* through *Ja6*. For unlocking, six push buttons K1 through K6 of twelve push buttons K1 through K0, KA, and KB (KA and KB not being shown) are successively depressed. At this time, contacts R1-1 through R5-1 respectively on one side of the above mentioned relays R1 through R5 are used doubly for self-holding circuits of the relays and as succeeding relay excitation circuits.

At the time of locking, any of the push buttons K2 through KB other than the push button K1 is depressed, whereupon locking is accomplishing in exactly the same manner as in the relay circuit illustrated in FIG. 2. In the case of an error in the successive depressing of the push buttons K1 through K6, also, resetting of circuit is effected similarly as in the relay circuit illustrated in FIG. 2.

Figure 4:
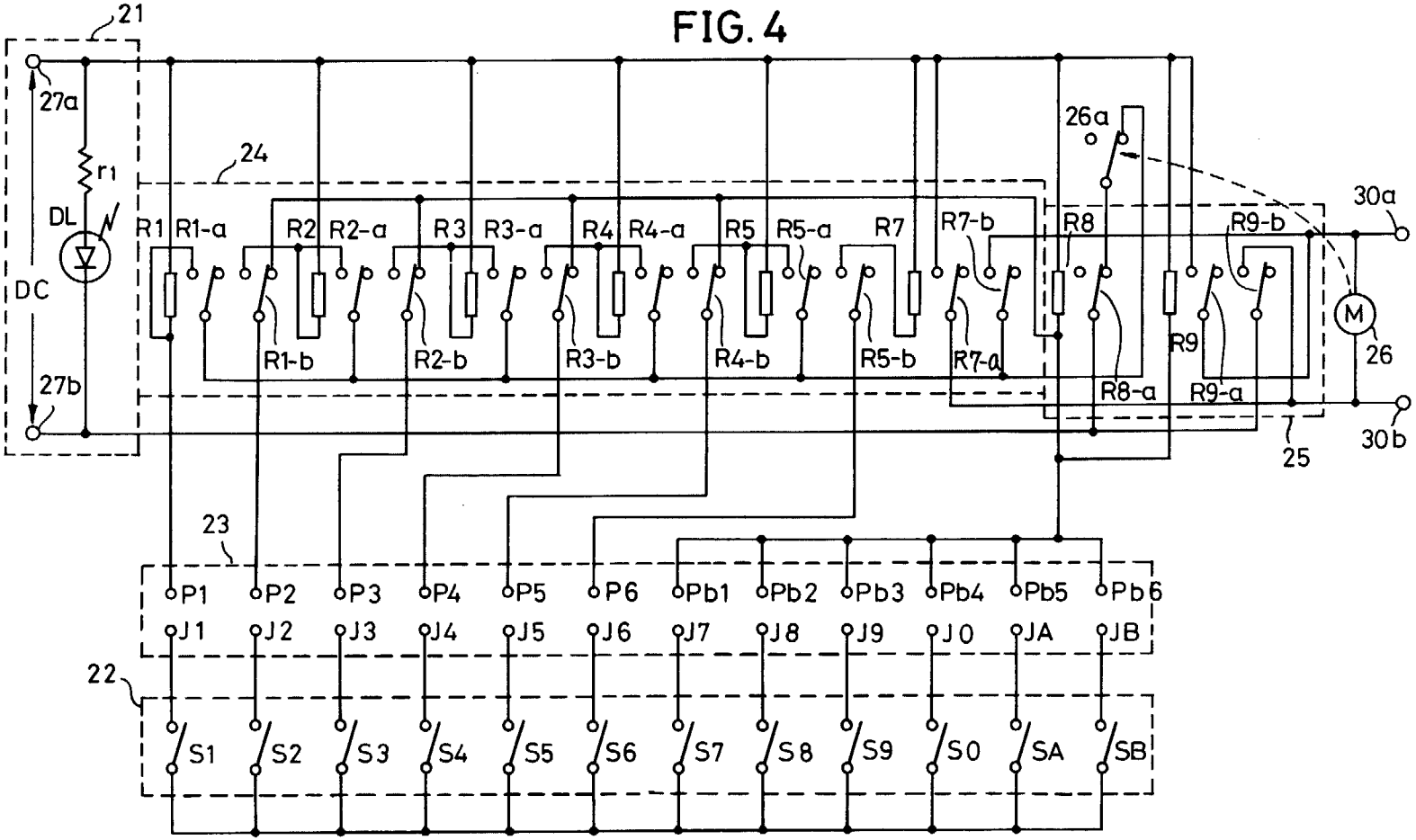

A third embodiment of the relay circuit of the invention will now be described with reference to FIG. 4. In FIG. 4, parts which are the same as corresponding parts in FIG. 2 are designated by like reference numerals and characters. Detailed description of such parts will not be repeated. The instant relay circuit is similar to that illustrated in FIG. 3 in that unlocking operation is carried out by depressing six out of twelve push buttons K1 through KB successively in a prescribed sequence. Relays R1 through R5 for unlocking respectively have pairs of changeover contacts. Furthermore, for the six plugs P1 through P6 for changing circuit connections, twelve jacks J1 through JB, and twelve switches S1 through SB, respectively, single-circuit types are used. In FIG. 4, to idle jacks J7 through JB, respectively, are connected plugs Pb1 through Pb6 having terminals on their one side connected to the relay R8 for release of self-holding and the relay R9 for locking.

For the sake of convenience, in description, it will be assumed that the plugs P1 through P6 are respectively connected to the jacks J1 through J6 in the instant embodiment. For unlocking, six push buttons K1 through K6 out of twelve push buttons K1 through KB are successively depressed. At this time, in the pairs of changeover contacts **R1-*a*, R1-*b*, through R5-*a*, R5-*b* of the relays R1 through R5 for unlocking, the left-hand contact points are used for self holding, while the right-hand contact points are used for the excitation circuit of the succeeding relays similarly as in the relay circuit illustrated in FIG. 2. At the time of locking, locking operation is accomplished by depressing any of the push buttons K2 through KB, other than button K1, in exactly the same manner as in the relay circuit shown in FIG. 2**.

When an error is made in the sequence of successive depressing of the push buttons K1 through K6, and a wrong push button is pushed, two cases can be considered. In the case where the wrong button is any of the push buttons K2 through K6, the relay R8 is energized through the respective plug among the plugs P2 through P6 and the right-hand changeover contact of the respective relay among the relays R2 through R5. In the case where the erroneously pushed button is any of the push buttons K7 through KB, the relay R8 is energized through the respective plug among the plugs Pb1 through Pb6. In either case, the respective relay self-holding circuit is released from its self held state, and resetting of circuit occurs.

Figure 5:
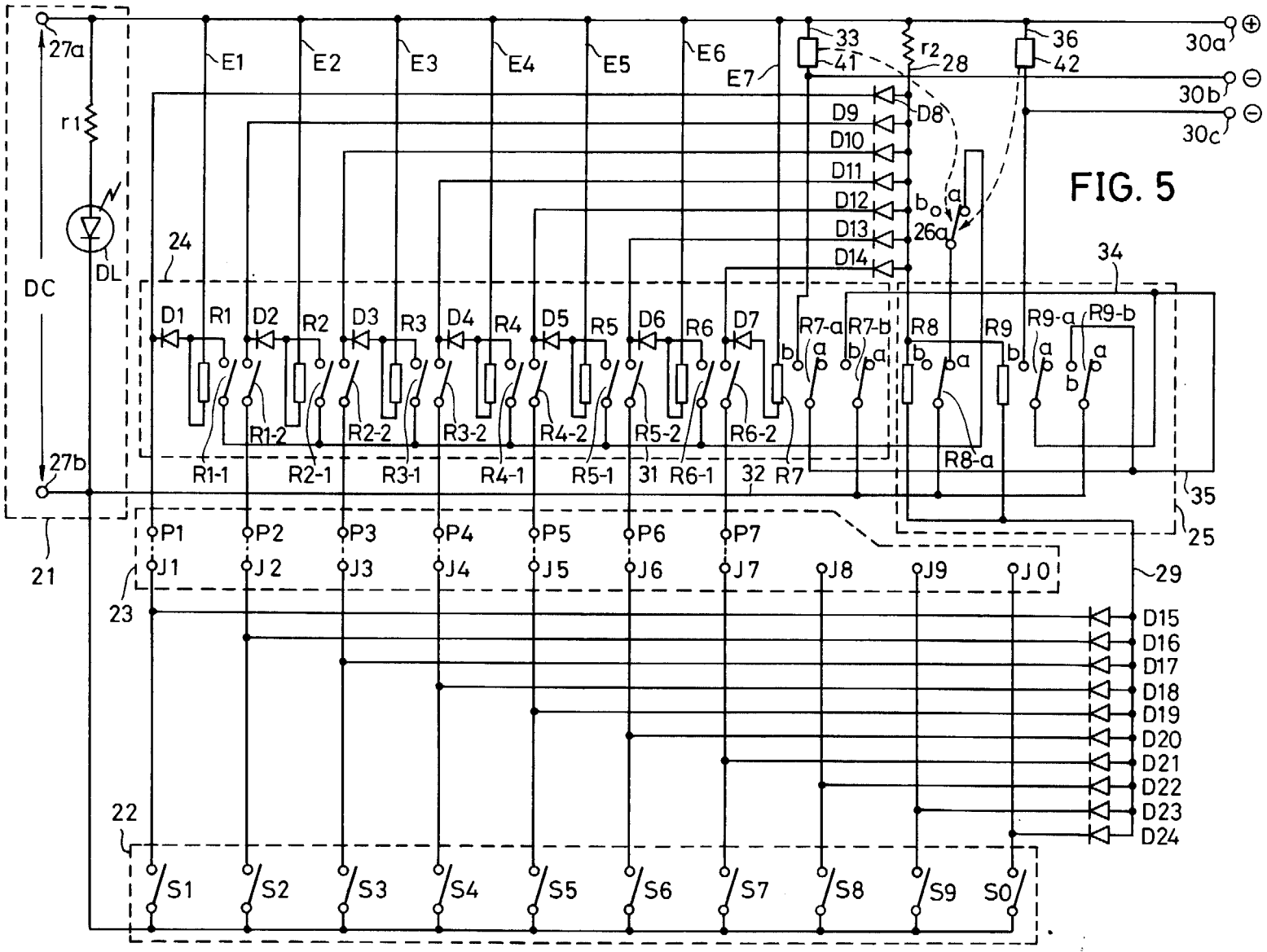

An embodiment of a modified relay circuit wherein, instead of the motor 26 in the relay circuit illustrated in FIG. 2, solenoids are used for carrying out unlocking and locking operations is shown in FIG. 5. In this circuit, a solenoid 41 for unlocking and a solenoid 42 for locking are respectively connected in intermediate points in lines 33 and 36. Each of these solenoids 41 and 42 is mechanically intercoupled with the microswitch contact **26*a* and the lock bolt 17. Other organizational features of this circuit are similar to those of the relay circuit shown in FIG. 2**.

At the time of unlocking, the solenoid 41 is energized by a current and thus operates to move the lock bolt 17 in sliding movement in the unlocking direction thereby to accomplish unlocking. At the same time, this solenoid 41 opens the microswitch contact **26*a*** thereby to release the relay self-holding circuit and cause the resetting of circuit.

At the time of locking, the solenoid 42 is energized and operates to move the bolt 17 in sliding movement in the locking direction thereby to accomplish locking and, at the same time, closes the contact **26*a*** thereby to prepare for the succeeding unlocking operation.

The manipulative procedures for depressing the push buttons K1 through K0 for the above described unlocking and locking are exactly the same as those in the case of the relay circuit shown in FIG. 2. Furthermore, terminals **30*a*, 30*b*, and 30*c* for emergency use are provided. When an emergency power supply is connected between the ⊕ side terminal 30*a* and the ⊖ side terminal 30*b*, the solenoid 41 operates to carry out unlocking. When the emergency power supply is connected between the ⊕ side terminal 30*a* and the ⊖ side terminal 30*c*, the solenoid 42** operates to carry out locking.

It will be obvious to those skilled in the art that the solenoids 41 and 42 can be used in a similar manner also in the relay circuits shown in FIGS. 3 and 4 in place of the motor 26.

Figure 6:
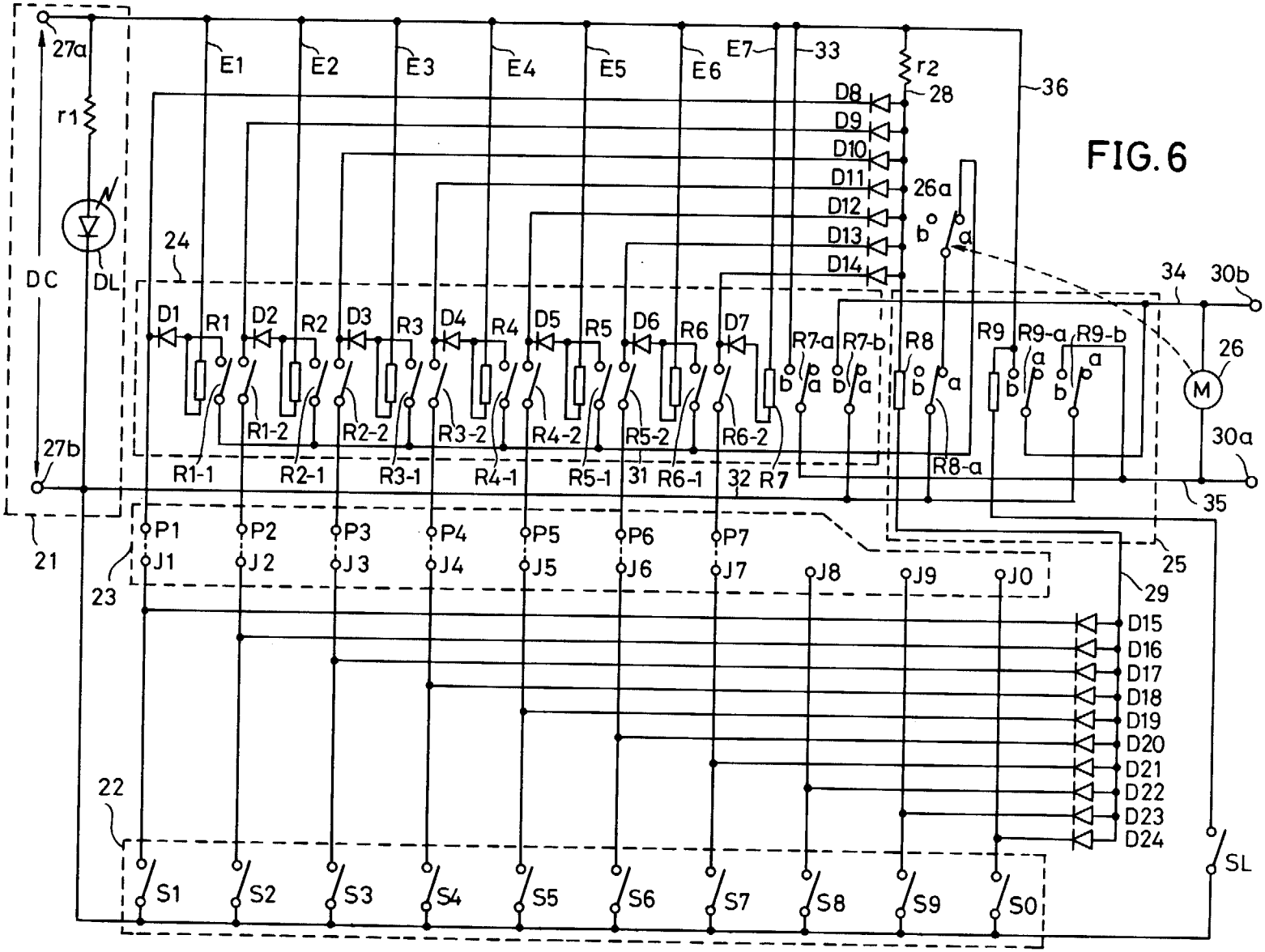

FIG. 6 shows the circuit of one embodiment of a locking device according to the invention wherein, instead of carrying out locking operation by closing any one of the switches S2 through S0 in FIG. 2, a switch SL for locking, which operates intercoupledly with a push button KL (not shown), is newly provided to carry out locking. The relay R9 for locking is independently connected to this switch SL.

For locking, the push button KL (not shown) is depressed to close the switch SL. The relay R9 for locking is thereupon energized, whereby the contacts **R9-*a* and R9-*b* thereof are closed, and the motor 26** rotates in the locking direction to carry out locking.

It will also be obvious that this switch SL for locking can be adapted for use also in the relay circuits shown in FIGS. 3 and 4. Furthermore, this switch SL can also be used in the relay circuits shown in FIGS. 2, 3, and 4 in conjunction with the above described solenoids 41 and 42.

Next, the number of possible combinations of the above mentioned jacks and the plugs which are variably connectable thereto will be considered.

There is no possibility of different plugs being connected simultaneously, to a single jack. Therefore, when $n$ jacks are to be connected to $k$ plugs (where $n \geqq k$), the number of combinations of such connections is expressed by the following equation.

$$\text{Number of combinations} = n!/(n-k)!$$

Accordingly, from this equation, the number of combinations of sequences of depressing the push buttons in the relay circuit illustrated in FIG. 2 is as follows.

$$10!/(10-7)! = 604{,}800 \text{ combinations.}$$

Similarly, the number of combinations of sequences of depressing the push buttons in each of the relay circuits shown in FIGS. 3 and 4 is as follows.

$$12!/(12-6)! = 665{,}280 \text{ combinations}$$

Therefore, it may be said that there is almost no probability of unlocking by accidental chance by a person who does not know the preset sequence of depressing of the push buttons.

As means for presetting the depressing sequence or serial numerals, plugs and jacks are used in each of the above described embodiments. A serial numeral is preset by inserting a plug into a jack corresponding to the serial numeral to be preset to make the connection. However, the serial numeral presetting means is not limited to the above described arrangement of plugs and jacks. For example, rotary switches can be used as illustrated in FIG. 7.

Figure 7:
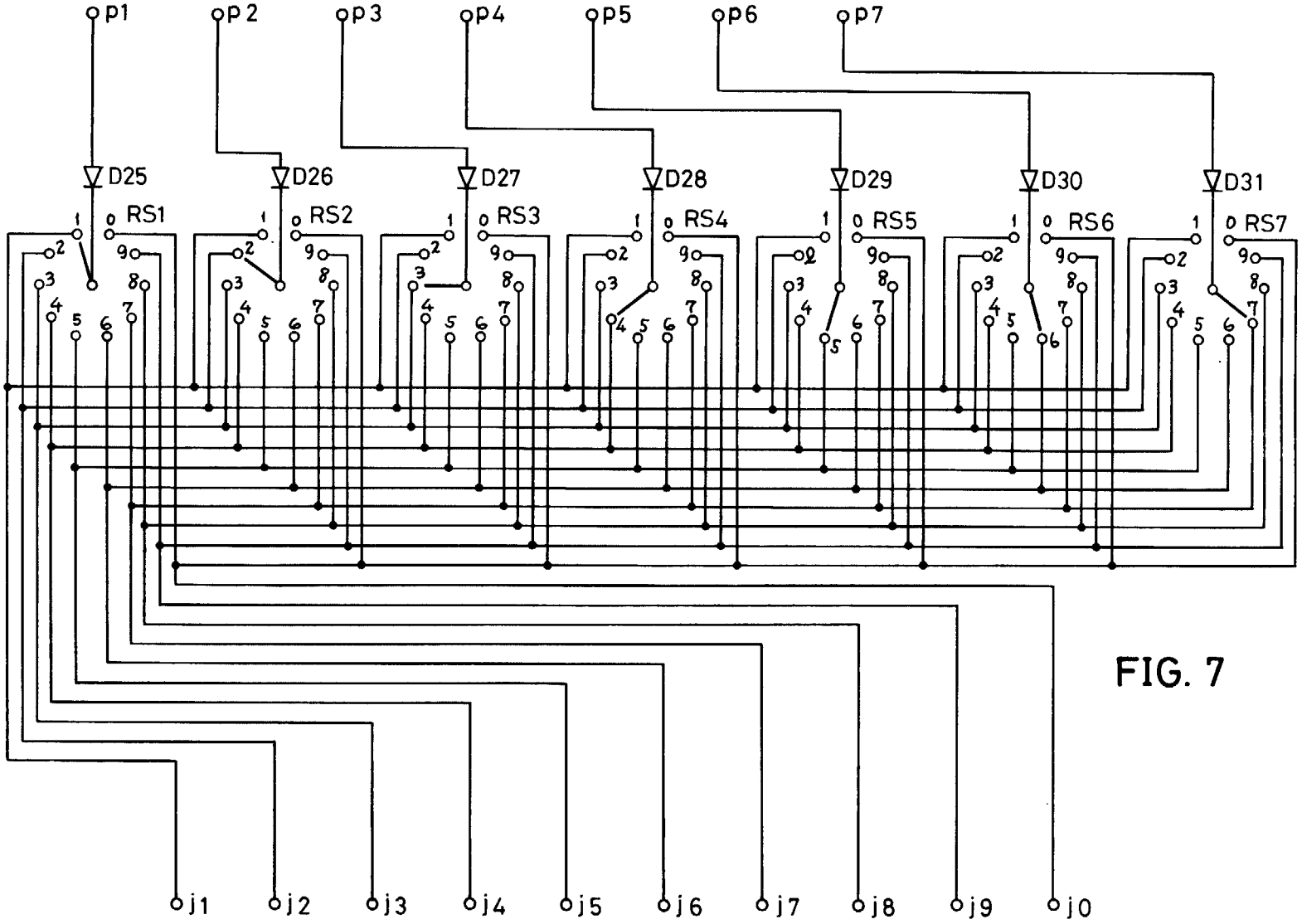
FIG. 7 is a circuit diagram of another embodiment of a numeral changing and setting means in the electric locking device of the invention.

In the arrangement shown in FIG. 7, terminals $p1$ through $p7$ are respectively connected fixedly in the positions of the plugs P1 through P7 in each of the embodiments illustrated in FIGS. 2 through 6. Furthermore, terminals $j1$ through $j0$ are respectively connected fixedly in the positions of the jacks J1 through J0 in each of the same preceding embodiments. Each of the seven rotary switches RS1 through RS7 in this arrangement comprises a rotary contact and ten fixed contact points corresponding respectively to the serial numerals from 1 to 0 as indicated in FIG. 3. The rotary contacts of the rotary switches RS1 through RS7 are respectively connected to the terminals $p1$ through $p7$ of the correspondingly same subscript numerals. Furthermore, the fixed contact points of these rotary switches are respectively connected to the terminals $j1$ through $j0$ of the correspondingly same subscript numerals. Diodes D25 through D31 are provided as shown for the purpose of preventing reverse current flow between the rotary switches RS1 through RS7.

The rotary contact of each of the rotary switches is rotated to and placed in contact with the fixed contact point corresponding to the serial numeral to be preset. In this presetting of the serial numerals, a numeral may be used any number of times provided that the same numeral is not used consecutively. That is, if the presetting is done in a manner to use the same serial numeral connectively, two relays will be simultaneously energized. This will be give rise to inconvenience, and, therefore, it is necessary to carry out presetting without consecutive repetition of the same numeral.

The number of possible combinations of sequences which can be preset by the above described rotary switches will be considered. It will be assumed that the sequence presetting is carried out with $k$ rotary switches each having $n$ contact points which are respectively selectable in a variable manner (where the magnitudes of $n$ and $k$ are immaterial). However, as long as contact points of same serial numeral are not used consecutively in a single sequence, contact points may be freely used. Accordingly, the number of selectable contact points in the first rotary switch is $n$. In the second through the kth rotary switches, only the contact point of the same serial numeral as the preceding rotary switch cannot be used. Consequently, the number of fixed contact points which can be selected is $(n-1)$. Therefore, the number of possible combinations of sequences is expressed by the following equation.

$$\text{Number of combination} = n \times \overbrace{(n-1) \times \ldots\ldots \times (n-1)}^{(k-1)} = n(n-1)^{k-1} \text{ combinations}$$

Therefore, the number of combinations of push button depressing sequences is as follows.

$$10 \times (10-1)^6 = 5{,}314{,}410 \text{ combinations}$$

For this reason, it can be said that the probability of a person who does not know the preset depressing sequence of the push buttons unlocking the locking device is almost zero.

Further, this invention is not limited to these embodiments but various variations and modifications may be made without departing from the scope and spirit of the invention.

What is claimed is:

1. An electric locking device comprising:

locking means for performing locking and unlocking operations;

a plural number ($n$) of manipulative control switches;

presetting circuit means having a plural number ($k$) of variable connecting means, respectively connected to said manipulative control switches, for selectively varying and presetting connection states with respect to said manipulative control switches;

a relay circuit for effecting an unlocking operation comprising a plurality ($k$) of relays for unlocking operation respectively connected to the variable connecting means of said presetting means and being successively supplied with electrical power from a power supply in a short-circuit manner as a result of closure of the plurality (K) of manipulative control switches, to which said variable connecting means are selectively connected, in a specific sequence determined by the variable connecting means;

electromagnetically energized self-holding circuits connected to said relays for the unlocking operation for respectively self-holding said relays for the unlocking operation as a result of electromagnetic energization of the self-holding circuits, whereby the succeeding relay in said specific sequence assumes an energizable state;

unlocking operation means operated by the energization of the final relay in said specific sequence of the relays for the unlocking operation in said relay circuit to cause said locking means to perform the unlocking operation;

a relay circuit for releasing the self-holding including one relay for releasing self-holding connected in a by-pass circuit to both sides of said presetting circuit means and to said relay circuit for the unlocking operation in parallel therewith;

said one relay for releasing self-holding not being energized when said relays for an unlocking operation are successively energized in a short-circuit manner as a result of closure of the manipulative control switches in said specific sequence, said one relay for releasing self-holding being energized in bypass circuit manner only when any one relay for the unlocking operation is not energized as a result of closure of the manipulative control switches in a sequence other than that corresonding to said specific sequence, thereby causing all the self-holding circuits of the relays for the unlocking operation to open for returning the device to the state prior to manipulation of said manipulative control switches; and a relay circuit for locking operation including one relay for a locking operation connected in parallel with said circuit for releasing self-holding;

said one relay for the locking operation, when said locking means is unlocked, being energized as a result of closure of at least any but the first in the sequence of the plurality (n) of manipulative control switches and operating said unlocking operation means to cause said locking means to perform the locking operation.

* * * * *